US010242765B2

(12) United States Patent
Zhang et al.

(10) Patent No.: US 10,242,765 B2
(45) Date of Patent: Mar. 26, 2019

(54) CONDUCTIVE MEMBER, IMAGE FORMING APPARATUS, CONDUCTIVE PARTICLE AND METHOD FOR MANUFACTURING THE SAME

(71) Applicant: Konica Minolta, Inc., Tokyo (JP)

(72) Inventors: Wanli Zhang, Aichi (JP); Kouichi Etou, Aichi (JP); Kazuyoshi Ota, Aichi (JP); Junji Kanda, Aichi (JP)

(73) Assignee: KONICA MINOLTA, INC., Tokyo (JP)

( * ) Notice: Subject to any disclaimer, the term of this patent is extended or adjusted under 35 U.S.C. 154(b) by 353 days.

(21) Appl. No.: 14/269,763

(22) Filed: May 5, 2014

(65) Prior Publication Data

US 2014/0332732 A1 Nov. 13, 2014

(30) Foreign Application Priority Data

May 9, 2013 (JP) ..... 2013-099329

(51) Int. Cl.
*H01B 1/24* (2006.01)

(52) U.S. Cl.
CPC ..... *H01B 1/24* (2013.01)

(58) Field of Classification Search
CPC ..... H01B 1/24
USPC ..... 252/500
See application file for complete search history.

(56) References Cited

U.S. PATENT DOCUMENTS

2004/0116553 A1* 6/2004 Nakamura ..... C09D 11/32 523/160
2005/0004261 A1* 1/2005 Yatake ..... C09D 11/322 523/160
2005/0136245 A1* 6/2005 Arita ..... G03G 7/0013 428/323
2011/0102231 A1* 5/2011 Matsumoto ..... B82Y 30/00 342/1
2012/0026240 A1* 2/2012 Saito ..... C09B 67/0013 347/21

FOREIGN PATENT DOCUMENTS

JP 2000-293047 10/2000
JP 2000293047 A * 10/2000
JP 2002-270032 A 9/2002
(Continued)

OTHER PUBLICATIONS

Office Action dated Jun. 2, 2015 issued from the corresponding Japanese patent application No. 2013-099329.
(Continued)

*Primary Examiner* — Mark Kopec
*Assistant Examiner* — Danny N Kang
(74) *Attorney, Agent, or Firm* — Lucas & Mercanti, LLP

(57) ABSTRACT

Conductive particle 10 has conductive carbon black particle (CB) 11 and cover layer 12. The amount of an insulating resin in conductive particle 10 is from 10 to 50% by mass. The number-average primary particle diameter of CB11 is from 20 to 60 nm; DBP absorption amount is from 100 to 200 mL/100 g. Cover layer 12 is formed by a phase-inversion emulsification method that contains an insulating resin having an amino group and CB11 in an oil phase. Conductive particle 10 is used suitably for a conductive agent of an intermediate transfer belt of an image forming apparatus.

17 Claims, 6 Drawing Sheets

(56) References Cited

FOREIGN PATENT DOCUMENTS

| | | |
|---|---|---|
| JP | 2005-272790 | 10/2005 |
| JP | 2012-046740 A | 3/2012 |

OTHER PUBLICATIONS

English translation of Office Action dated Jun. 2, 2015 issued from the corresponding Japanese patent application No. 2013-099329.

* cited by examiner

CONDUCTIVE MEMBER, IMAGE FORMING APPARATUS, CONDUCTIVE PARTICLE AND METHOD FOR MANUFACTURING THE SAME

CROSS REFERENCE TO RELATED APPLICATIONS

This application is entitled to and claims the benefit of Japanese Patent Application No. 2013-099329, filed on May 9, 2013, the disclosure of which including the specification, drawings and abstract is incorporated herein by reference in its entirety.

BACKGROUND OF THE INVENTION

Field of the Invention

The present invention relates to a conductive member, an image forming apparatus having the conductive member, a conductive particle contained in the conductive member, and a method for manufacturing the conductive particle.

Description of Related Art

In image forming apparatus using an electrophotographic process, generally, a toner image formed on a photoconductor is transferred from the photoconductor to an intermediate transfer belt, and then from the intermediate transfer belt to a recording medium. As the intermediate transfer belt, for example, electrically conductive, flexible endless belts have been used. Such a conductive belt is formed for example of a conductive composition such as resin or rubber in which conductive carbon black particles are dispersed. The conductivity of the conductive belt is adjusted by the amount of the conductive carbon black particles.

When the amount of the conductive carbon black particles exceeds a certain value, however, the electric resistance of the conductive belt decreases largely. Such a phenomenon wherein the electric resistance of a conductive belt decreases largely due to a slight increase in the amount of the conductive carbon black particles is called "percolation." It is thus difficult to adjust the surface resistivity of a conductive belt to a level obtained when adding conductive carbon black particles in an amount near the amount where percolation occurs, e.g., $1.0\times10^{6}$ to $1.0\times10^{13}\Omega/\square$, a level referred to as semiconductivity.

Known techniques for preventing percolation include covering the surface of conductive carbon black particles with silica (e.g., Japanese Patent Laid-Open No. 2002-270032), and physically covering the surface of conductive carbon black particles with resin (e.g., Japanese Patent Laid-Open No. 2012-46740). With these techniques, the formation of conductive paths due to contact among conductive carbon black particles is prevented.

In the former technique, covering of the surface of the conductive carbon black particles with silica is accomplished either by mechanical mixing of the conductive carbon black particles with silica or by contact of conductive carbon black particles with $SiO_x$ gas. With the method involving mechanical mixing, however, it is difficult to make uniform the thickness of the silica cover layer covering the surface of the conductive carbon black particles. With the method involving contact with $SiO_x$ gas, a silanol group exists on the surface of the silica cover layer and hydrogen bonding is formed between the covered conductive carbon black particles. Therefore, when the covered conductive carbon black particles are mixed in a matrix resin that constitute the conductive belt, the covered conductive carbon black particles aggregate easily and, in some cases, the dispersibility of the covered conductive carbon black particles becomes insufficient.

With the latter technique, the contact resistance between the conductive carbon black particle and the resin layer covering the conductive carbon black particle may become too high, or the thickness of the cover layer formed of resin may become uneven. It is therefore difficult to stably obtain a conductive member having desired conductivity.

SUMMARY OF THE INVENTION

An object of the present invention is to provide a conductive member that has desired conductivity and prevents percolation.

Another object of the present invention is to provide an image forming apparatus having the conductive member, or conductive particles that are excellent in dispersibility in a matrix resin of the conductive member, have desired conductivity and are capable of preventing percolation.

To accomplish at least one of the objects, the conductive member reflecting one aspect of the present invention comprises a matrix resin, and conductive particles dispersed in the matrix resin. The conductive particle has a conductive carbon black particle, and a cover layer that covers the surface of the conductive carbon black particle. The number-average primary particle diameter of the conductive carbon black particle is 20 to 60 nm, and the dibutylphthalate absorption amount of the conductive carbon black particle is from 100 to 200 mL/100 g. The cover layer is formed of an insulating resin having an amino group, and the amount of the insulating resin in the conductive particle is 10 to 50% by mass.

To accomplish at least one of the objects, the image forming apparatus reflecting one aspect of the present invention comprises an intermediate transfer belt formed of the conductive member, for transferring a toner image formed on an electrophotographic photoconductor to a recording medium.

To accomplish at least one of the objects, the conductive particle reflecting one aspect of the present invention comprises the conductive carbon black particle and the cover layer.

To accomplish at least one of the objects, the method for manufacturing a conductive particle reflecting one aspect of the present invention is a method for manufacturing a conductive particle in which the surface of the conductive carbon black particle is covered with the cover layer formed of the insulating resin, the method including: adding an aqueous medium to a hydrophobic dispersion liquid prepared by dissolving an insulating resin in a hydrophobic organic solvent and dispersing conductive carbon black particles in an amount greater than that of the hydrophobic dispersion liquid to emulsify the aqueous medium and the hydrophobic dispersion liquid; and distilling away the organic solvent from the emulsion of the hydrophobic dispersion liquid and the aqueous medium to fix the insulating resin to the surface of the conductive carbon black particle. The number-average primary particle diameter of the conductive carbon black particle is from 20 to 60 nm, and the dibutylphthalate absorption amount of the conductive carbon black particle is from 100 to 200 mL/100 g, and the insulating resin has an amino group.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Conductive Particle

A conductive particle according to the embodiment of the present invention has a conductive carbon black particle and a cover layer covering the surface of the conductive carbon black particle.

Figure 1:
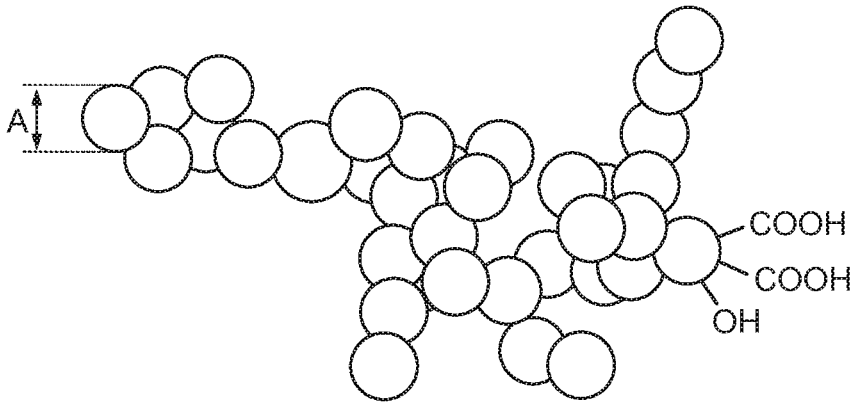
FIG. 1 illustrates schematically a structure of a conductive carbon black particle.

The number-average primary particle diameter of the conductive carbon black particle is from 20 to 60 nm. The conductive carbon black particle is generally an aggregate of a plurality of fused spherical small particles (primary particles) made of the conductive carbon black, as shown in FIG. 1. The number-average primary particle diameter of the conductive carbon black particle indicates, as shown by A in FIG. 1, the size of the primary particle. When the number-average primary particle diameter is less than 20 nm, the specific surface area of the conductive carbon black particle may be large, so that the conductive carbon black particle may have large surface tension resulting in strong cohesive aggregation of conductive carbon black particles which may reduce the dispersibility of the conductive carbon black particles in a hydrophobic organic solvent or insulating resin (later described). When the number-average primary particle diameter is larger than 60 nm, a structure to be mentioned later may become small and the conductivity of the conductive carbon black particle may become insufficient. The number-average primary particle diameter is preferably from 20 to 60 nm from the viewpoint of the improvement of the conductivity and dispersibility of the conductive carbon black particles, and more preferably from 30 to 50 nm. The number-average primary particle diameter can be measured, for example, by observation with a transmission electron microscope (TEM).

Further, the dibutylphthalate (DBP) absorption amount of the conductive carbon black particle is from 100 to 200 mL/100 g. The conductive carbon black particle is formed by a complex aggregation of the primary particles.

The size of the chain of the primary particles is generally called a "structure," and a larger structure tends to give a more complex form of the aggregate and to give better conductivity and dispersibility of the conductive carbon black particles.

The DBP absorption amount is represented typically by the volume (mL) of DBP absorbed by 100 g of the conductive carbon black particles; a larger value of the DBP absorption amount represents a larger structure. When the DBP absorption amount is less than 100 mL/100 g, the structure is so small that the conductivity of the conductive carbon black particles may become insufficient. When the DBP absorption amount is larger than 200 mL/100 g, the structure is so large that the dispersibility in a hydrophobic organic solvent to be mentioned later may become insufficient.

The DBP absorption amount can be obtained using any of the methods known in the art, such as JIS K6217. Alternately, it is possible to presume the DBP absorption amount by observing the structure of the conductive carbon black particle in the conductive particle covered with a cover layer with a TEM or the like, and comparing the same with that of a conductive carbon black particle having a known DBP absorption amount. The DBP absorption amount is more preferably from 100 to 150 mL/100 g from the viewpoint of improving the conductivity and dispersibility.

The cover layer is formed of an insulating resin having an amino group. The insulating resin having an amino group has a surface resistivity of for example $1\times10^{13}\Omega/\square$ or more. The surface resistivity of the insulating resin can be measured by a method in conformity to JIS K6911 wherein a sheet-like specimen, for example, is prepared by injection molding or hot press molding.

The number of the amino group of the insulating resin is not particularly limited; the insulating resin may have one or two or more amino groups. Examples of the insulating resins having an amino group include amine-modified styrene elastomers, polyamide elastomers, polyamides, and polyamideimides. Examples of the polyamides include Nylon 6, Nylon 66 and Nylon 610. The amine value of the polyamide is preferably larger than the acid value of the polyamide.

The insulating resin is preferably an amine-modified styrene elastomer or polyamide elastomer because it is expected to contribute to further improvement in the mechanical strength of a conductive member such as impact strength and tear strength, caused by flexibility of the insulating resin when the conductive particles are dispersed in a matrix resin to be mentioned later.

The amount of the insulating resin in the conductive particle is from 10 to 50% by mass. When the amount is less than 10% by mass, the effect of suppressing the generation of percolation in the conductive member to be mentioned later becomes insufficient in some cases. When the amount is more than 50% by mass, the conductivity of the conductive particle becomes insufficient in some cases. The amount of the insulating resin in the conductive particle can be obtained, for example, by the observation with a TEM.

The cover layer is produced by covering the conductive carbon black particle with the insulating resin. Examples of the method for producing the cover layer include dry mixing of an insulating resin swelled with an organic solvent with the conductive carbon black particles, and phase-inversion emulsification method employing as an oil phase a hydrophobic dispersion liquid containing dispersed conductive carbon black particles and dissolved insulating resin. The cover layer is preferably produced by the phase-inversion emulsification method from the viewpoint of producing a cover layer that has a uniform and suitable thickness and closely adheres to the surface of the conductive carbon black particle.

Figure 2A:
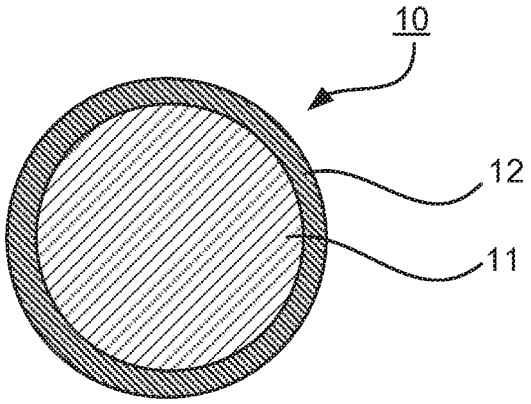
FIG. 2A is a cross-sectional view of one example of a conductive particle produced by phase-inversion emulsification.
Figure 2B:
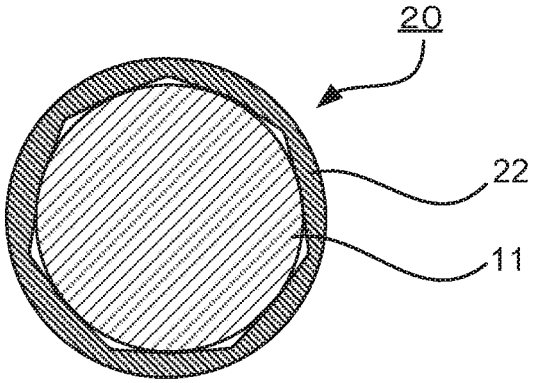
FIG. 2B is cross-sectional view of one example of a conductive particle produced by a method other than phase-inversion emulsification.

FIG. 2A is a schematic cross-sectional view of one example of a conductive particle produced by phase-inversion emulsification (conductive particle 10), and FIG. 2B is a schematic cross-sectional view of one example of a conductive particle produced by a method other than the phase-inversion emulsification (conductive particle 20). Cover layer 12 produced by the phase-inversion emulsification adheres closely to the surface of conductive carbon black particle (above-described aggregate) 11 as shown in FIG. 2A. Cover layer 22 produced by a method other than the phase-inversion emulsification method contacts with the surface of conductive carbon black particle 11; however, space may be formed between the layer and conductive carbon black particle 11 as shown in FIG. 2B.

The degree of contact between the conductive carbon black particle and the cover layer may be confirmed by checking that the amount of the insulating resin lies in the above-described range or that the cover layer has a suitable thickness. Suitable thickness of the cover layer is considered to confer to the conductive particle a uniform desired conductivity that prevents the occurrence of percolation. The thickness of the cover layer is preferably from 1 to 10 nm from the viewpoint of causing the cover layer to contact sufficiently to the surface of the conductive carbon black particle so that the above-described conductivity is attained, and more preferably from 2 to 6 nm. The thickness of the cover layer is measured for example by observation with a transmission electron microscope (TEM) (to measure the thickness of a shell layer in a core-shell structure of the conductive particle). Further, the thickness of the cover layer is adjusted for example by the addition amount of the insulating resin during the production of the cover layer.

The following describes a possible mechanism by which cover layer 12 uniformly adheres closely to the surface of conductive carbon black particle 11 having a complex surface shape by the phase-inversion emulsification method.

On the surface of a primary particle, a plurality of functional groups such as carboxyl group and hydroxyl group exists as shown in FIG. 1. On the other hand, the insulating resin forming cover layer 12 has an amino group. In the phase-inversion emulsification, the amino group of the insulating resin acts on the functional group (e.g., carboxyl group) on the primary particle by the formation of hydrogen bonding, ionic bonding associated with a neutralization reaction, covalent bonding by the formation of an amide bond, and so forth. It is considered that, as described above, since the insulating resin becomes the cover layer in the state of being fixed to the surface of the primary particle via the amino groups of the molecule of the insulating resin, cover layer 12 adheres closely to the surface of conductive carbon black particle 11 in a uniform thickness.

The interaction between the insulating resin and the conductive carbon black particle is also expected in methods other than the phase-inversion emulsification method. It is considered, however, that a part of the surface of the conductive carbon black particle, the part where the amino group of the insulating resin does not reach, forms the space described above.

It is also considered that the amino group in the insulating resin serves as a contact point of the insulating resin to the surface of the conductive carbon black particle when forming the cover layer and also contributes to the improvement in the conductivity. That is, it is expected that the structure in which the insulating resin contacts with the conductive carbon black particle via the amino group contributes to the reduction in the contact resistance between the insulating resin and the conductive carbon black particle. Accordingly, the number of the amino groups in the insulating resin is preferably more than one from the viewpoint of enhancing the conductivity and close adhesion of the cover layer.

The insulating resin gives suitable conductivity to the cover layer, and enhances the dispersibility of conductive carbon black particles in the matrix resin in the conductive member to be mentioned later. Accordingly, conductive particles are dispersed uniformly in the conductive member due to the affinity between the insulating resin and the matrix resin, and contact one another via their cover layer. Accordingly, in the conductive member, the formation of a conduction path due to direct contact among conductive carbon black particles is prevented. Consequently, even when the conductive member contains conductive particles in such an amount that the conductive particles contact with one another, percolation is prevented in the conductive member, and moderate conductivity such as semiconductivity is developed.

[Method for Manufacturing Conductive Particle]

The conductive particle is manufactured suitably by a method including a first process and a second process described below.

The first process is a process of adding an aqueous medium to a hydrophobic dispersion liquid in an amount larger than that of the hydrophobic dispersion liquid to emulsify the aqueous medium and the hydrophobic dispersion liquid. By adding a large amount of aqueous medium to a small amount of the hydrophobic dispersion liquid being an oil phase while emulsifying, the phase-inversion emulsification is accomplished. By the phase-inversion emulsification, an O/W type emulsion is obtained which contains as a dispersoid fine droplets of oil phase, each of which has the conductive carbon black particle as a nucleus.

The hydrophobic dispersion liquid is prepared by dissolving the insulating resin in a hydrophobic organic solvent and dispersing the conductive carbon black particles. The hydrophobic dispersion liquid is prepared typically by dispersing the conductive carbon black particles in a hydrophobic organic solvent and then dissolving the insulating resin; however, the conductive carbon black particles may be dispersed after dissolving the insulating resin in a hydrophobic organic solvent, if it is carried out under conditions that accomplish good dispersion of the conductive carbon black particles (e.g., sufficient stirring). The amount of the conductive carbon black particles in the hydrophobic dispersion liquid is determined suitably within the range in which the conductive carbon black particles are dispersed sufficiently in the hydrophobic dispersion liquid.

The hydrophobic organic solvent is not particularly limited as long as it is a solvent that dissolves the insulating resin. Examples of the hydrophobic organic solvents include aromatic hydrocarbon compounds such as toluene and xylene, aliphatic hydrocarbon compounds such as hexane, and chlorinated aliphatic hydrocarbon compounds such as methylene chloride and carbon tetrachloride.

In the manufacturing method, when the molecular weight of the insulating resin is too low, there may occur cases wherein an odor is generated during the manufacturing, or the hydrophobicity of the hydrophobic dispersion liquid decreases resulting in failure to accomplish a good emulsification state during phase-inversion emulsification. On the other hand, when the molecular weight of the insulating resin is too high, there may occur cases wherein the insulating resin is not dissolved sufficiently in the hydrophobic organic solvent, or the viscosity of the resultant solution becomes too high resulting in insufficient dispersibility of the hydrophobic dispersion liquid in the phase-inversion emulsification. For these reasons for manufacturing, the molecular weight of the insulating resin can be determined for example from the range of 10,000 to 60,000 in weight-average molecular weight.

The hydrophobic dispersion liquid may additionally contain other component(s) in amounts that provide the effect of the present embodiment. Examples of the other components include oleophilic surfactants, cross-linking agents for cross-linking molecules of insulating resin, ionic conductive agents for adjusting the conductivity of the cover layer, dispersing agents such as polymer surfactants (e.g., HOMOGENOL (registered trademark of Kao Corporation) L-1820, manufactured by Kao Corporation), and pH adjusters such as sodium hydrogen carbonate and acetic acid.

The aqueous medium is a liquid dispersion medium which is water or contains water as the main component. The aqueous medium may additionally contain other component(s) such as water-soluble organic solvents such as alcohols, surfactants, and pH adjusters such as sodium hydrogen carbonate and acetic acid, in amounts that allow an emulsion of the hydrophobic dispersion liquid to be formed. The addition amount of the aqueous medium to the hydrophobic dispersion liquid is not particularly limited as long as the amount is larger than that of the hydrophobic dispersion liquid in volume ratio and is for example 2 to 10 volumes of the hydrophobic dispersion liquid.

The emulsification by the addition of the aqueous medium to the hydrophobic dispersion liquid can be carried out for example by adding the aqueous medium to the hydrophobic dispersion liquid under stirring. The stirring speed is not particularly limited as long as it is in a range that allows the emulsion of the hydrophobic dispersion liquid to be formed. The stirring speed in the first process may be constant or may be changed intermittently or continuously. Further, the temperatures of the hydrophobic dispersion liquid and the aqueous medium in the first process are not particularly limited. For example, to dissolve the insulating resin, the hydrophobic dispersion liquid may be heated, or the aqueous medium may be heated in the same way.

The second process is a process of distilling away the hydrophobic organic solvent from the emulsion of the hydrophobic dispersion liquid and the aqueous medium thereby to fix the insulating resin to the surface of the conductive carbon black particle. The distillation of the hydrophobic organic solvent from the emulsion is carried out advantageously by for example vacuum concentration. The amount of the hydrophobic organic solvent to be distilled away from the emulsion can be determined suitably in a range where the insulating resin is fixed to the surface of the conductive carbon black particle (that is, forms the cover layer), and, for example, a part of the hydrophobic organic solvent may remain in the emulsion.

The afore mentioned manufacturing method may additionally contain a process other than the first process and the second process, in a range where the effect of the present embodiment is obtained. Examples of the other processes include washing process, and pulverization process.

The procedure of the manufacturing method will be explained more specifically.

First, the conductive carbon black particles are dispersed in hydrophobic organic solvent A (e.g., hexane) thereby to prepare the hydrophobic dispersion liquid. In the preparation, a known stirring or dispersion apparatus such as an ultrasonic dispersing machine or a bead mill can suitably be used. To organic solvent A, a dispersing agent may be added.

Next, in the prepared hydrophobic dispersion liquid, the insulating resin (for example, amino-modified polystyrene) is dissolved thereby to prepare the hydrophobic dispersion liquid containing the insulating resin and the conductive carbon black particles.

Next, while stirring (for example, with a blade stirrer) the prepared hydrophobic dispersion liquid, distilled water (solvent B) in which an emulsifying agent (for example, EMULGEN (registered trademark of Kao Corporation) 1108) is mixed is added dropwise gradually to the hydrophobic dispersion liquid and causes the hydrophobic dispersion liquid to be phase-inversion emulsified thereby to prepare an emulsion.

Next, the prepared emulsion is dried, for example, at 40° C. thereby to evaporate organic solvent A. After that, the emulsion is dried at 80° C. to furthermore evaporate solvent B. The evaporation may be carried out under reduced pressure. In this way, the conductive particle is extracted from the emulsion. The extraction of the conductive particle from the emulsion may also be carried out suitably by filtration.

By dispersing the conductive carbon black particles in the solution of the insulating resin, and pouring water into the obtained dispersion liquid thereby to emulsify the same as described above, droplet particles are obtained, in each of which the solution of the insulating resin wraps the conductive carbon black particle. By removing the hydrophobic organic solvent and, if necessary, water from the emulsion containing the droplet particle as a dispersoid and drying the separated particles, fine particles in the form of core-shell structure are obtained as conductive particles, wherein the conductive carbon black particle is the core and the insulating resin as the shell. In the conductive particle, since the affinity between the insulating resin having an amino group and the conductive carbon black particle is high, the contact resistance at the interface between the conductive carbon black particle and the cover layer is low. Consequently, conductivity can be expressed while suppressing the percolation in the conductive member.

[Conductive Composition and Conductive Member]

The conductive composition according to the present embodiment contains a matrix resin and the conductive particles dispersed in the matrix resin. The "conductive composition" is a matter in which the conductive particles are dispersed in the matrix resin. The form of the conductive composition is not particularly limited and is typically a form that is suitable for subsequent molding. For example, the conductive composition may be in the form of pellet, sheet or slurry.

The conductive member according to the present embodiment contains the conductive composition. The "conductive member" is a member configured to contain a part formed of the conductive composition to be used for a specified application that requires conductivity. For example, the conductive member may be an endless belt or a roll. The conductive member may be formed of the conductive composition alone, or a part of the conductive member may be formed of the conductive composition.

The matrix resin is not particularly limited and may be selected suitably from those known in the art. Examples of the matrix resins include polystyrene, polyesters polyamides, polyimides, polyamideimides, polyphenylene sulfides, thermoplastic elastomers, chloroprene rubbers, nitrile rubber, silicone rubber, and polyurethane. The matrix resin can suitably be selected according to the intended application of the conductive member; for example, the matrix resin for an elastic layer of the intermediate transfer belt is preferably chloroprene rubber, thermoplastic urethane or the like.

In addition, the matrix resin is preferably a resin that contains a structural unit that is the same as or similar to that of the insulating resin, or that has the same properties as the insulating resin, from the viewpoint of enhancing the dispersibility of the conductive particles in the conductive member. For example, when the insulating resin is an amine-modified styrene elastomer, the matrix resin is preferably a resin having low polarity such as polystyrene, polyethylene, thermoplastic elastomer or silicone rubber. When the insulating resin is polyamide elastomer, polyamide or polyamideimide, the matrix resin is preferably a resin or rubber having high polarity such as polyamide, polyimide, polyamideimide, polyphenylene sulfide, chloroprene rubber, nitrile rubber or polyurethane. In this way, when the insulating resin has a certain level of compatibility with the matrix resin, the conductive particles are dispersed more easily in the matrix resin.

In the conductive member, when the amount of conventional conductive particles such as conductive carbon black particles is too large, percolation occurs easily, and when the amount is too small, the conductivity of the conductive member becomes insufficient in some times. However, since the conductive particle according to the present embodiment has moderate conductivity, it is possible to prevent percolation even when an amount larger than the amount for ordinary conductive particles is blended, and to adjust the conductivity of the conductive member according to the amount of the conductive particles. Therefore, the application of the conductive particles according to the present embodiment to a conductive composition or a conductive member that gives the amount of the conductive particles of from 1 to 50 parts by mass to 100 parts by mass of the matrix resin, more preferably from 1 to 20 parts by mass is more effective from the viewpoint of the prevention of percolation or the adjustment of the conductivity.

Figure 3A:
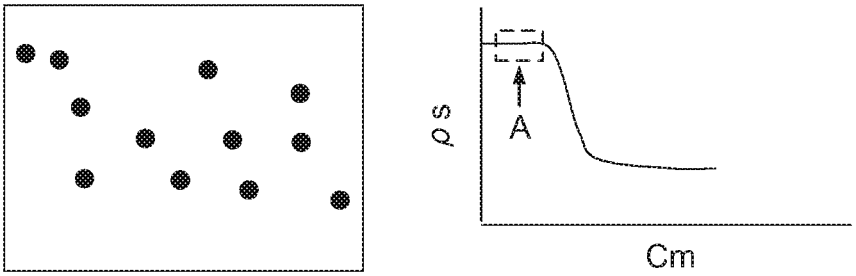
FIGS. 3A to 3D illustrate a relationship between surface resistivity (ρs) and the content (Cm) of conductive carbon black particles in a conductive member containing conductive carbon black particles.

In the conductive member, a conductive path is formed by the conductive particles. FIGS. 3A to 3D illustrate a relationship between surface resistivity (ρs) and the amount of the conductive particles (Cm) in a conductive member containing conductive carbon black particles as conductive particles. For example, as shown in FIG. 3A, when the amount of the conductive carbon black particles is small, almost no charge flows through the conductive member. Accordingly, the surface resistivity of the conductive member is high.

Figure 3B:
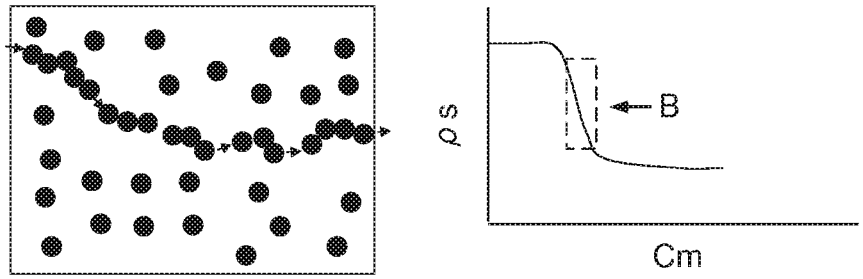
Figure 3C:
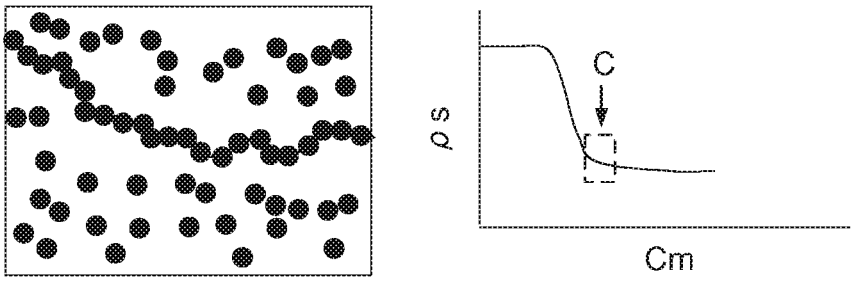
Figure 3D:
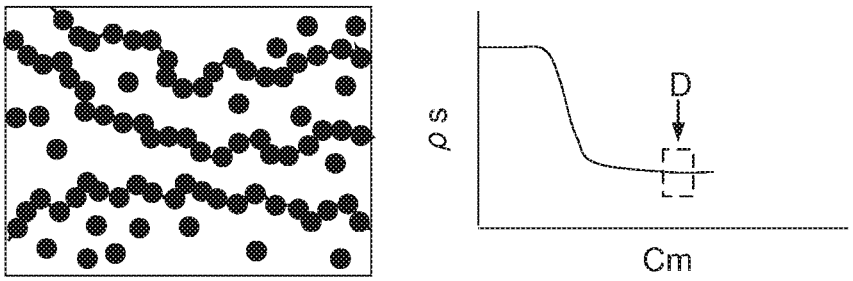

When the amount of the conductive carbon black particles increases gradually, the distance between conductive carbon black particles shortens gradually. Then, as shown in FIG. 3B, when the amount exceeds a certain value, a direct path of charges by conductive carbon black particles is formed. Since the specific resistance of the conductive carbon black particle is extremely low as compared with that of the matrix resin, the surface resistivity of the conductive member decreases at the moment of the formation of the direct path. This is percolation. When the amount of the conductive carbon black particles exceeds an amount that causes percolation, as shown in FIG. 3C and FIG. 3D, the surface resistivity of the conductive member generally is reduced scarcely even if the amount of the conductive carbon black particles is increased.

Figure 4A:
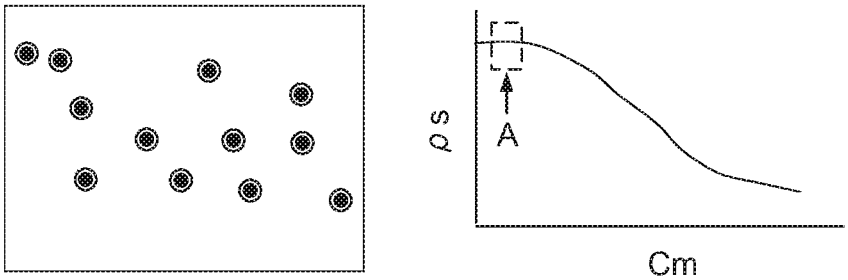
FIGS. 4A to 4D illustrate a relationship between surface resistivity (ρs) and the content (Cm) of conductive particles in a conductive member containing the conductive particles according to the present embodiment.

FIGS. 4A to 4D illustrate a relationship between the surface resistivity (ρs) and the amount of the conductive particles (Cm) in the conductive member containing the conductive particles according to the present embodiment. As shown in FIG. 4A, a phenomenon that a charge flows scarcely to the conductive member when the amount of the conductive particles is small is the same as in the case of the conductive carbon black particle.

Figure 4B:
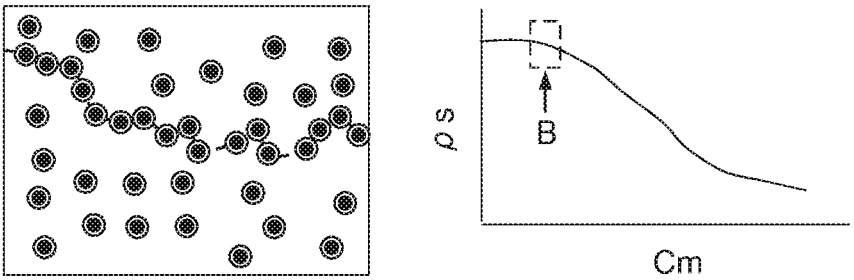

However, as shown in FIG. 4B, even when the conductive particles are present in an amount that is sufficient for forming a direct path, since the conductive particles have the cover layer made of insulating resin in a moderate amount (thickness), the formation of a direct path caused by the substantial linking of conductive carbon black particles is prevented and the percolation in the conductive member is prevented. Furthermore, since the insulating resin has an amino group, it is considered that the amino group and a functional group on the surface of the conductive carbon black particle have an interaction such as bonding and, therefore, the contact resistance at the interface between the conductive carbon black particle and the insulating resin becomes low. Consequently, the conductive member expresses the conductivity while the percolation is being prevented.

Figure 4C:
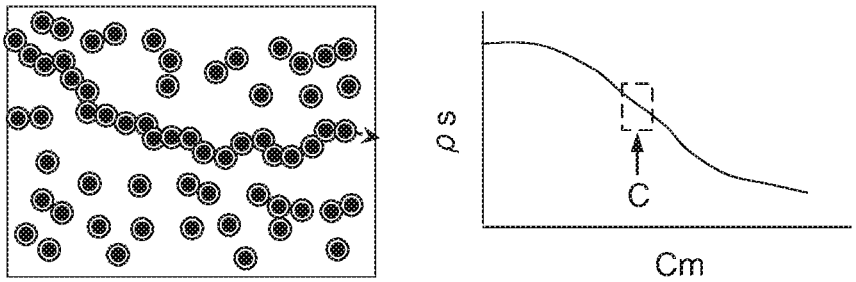
Figure 4D:
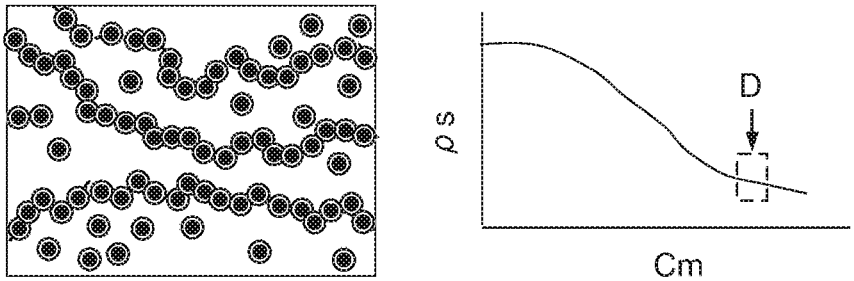

The conductivity of the conductive member increases gradually, as shown in FIGS. 4C and 4D, when the amount of the conductive particles is increased as compared with the case where the amount of conductive carbon black particles is increased. Consequently, it becomes possible to cause a desired conductivity in the conductive member to be expressed stably, substantially without the influence of the content and quality of a dispersion state of the conductive particles.

As described above, the conductive particle has moderate conductivity and, therefore, is suitable for forming a conductive member having a so-called semiconductivity. That is, the variation in conductivity of the conductive member corresponding to the amount of the conductive particles becomes smaller. Accordingly, the conductive member according to the present embodiment is applied preferably to a conductive member that requires conductivity of semiconductivity (in surface resistivity, from $1.0\times10^{9}$ to $1.0\times10^{13}\Omega/\square$).

The above-described conductive member is manufactured for example by dissolving or dispersing the conductive composition in an organic solvent that dissolves the matrix resin (a low boiling point or a highly polar organic solvent such as tetrahydrofuran), then defining the shape of the dispersion liquid by a method such as pouring the obtained dispersion liquid in a mold if necessary, and distilling away the organic solvent from the dispersion liquid having been defined in the shape.

The shape of the conductive member is not particularly limited. Further, the conductive member may additionally have other constituent component(s) in amounts that provide the effect of the present embodiment. Examples of other constituent components include various layers and members that support or cover a member formed of the conductive composition according to the present embodiment, such as a base material layer and a roller having the layer of the conductive composition on the surface, and a layer covering the surface of a member formed of the conductive composition.

[Image Forming Apparatus]

The image forming apparatus according to the present embodiment may be configured in the same way as a known image forming apparatus having an intermediate transfer member, except for having the aforementioned intermediate transfer member being formed of the conductive member. The image forming apparatus has, for example, a photoconductor, a charging device that charges the photoconductor, an exposing device that irradiates the charged photoconductor with light and forms an electrostatic latent image, a developing device that supplies toner to the photoconductor on which the electrostatic latent image is formed and forms a toner image corresponding to the electrostatic latent image, a transferring device for transferring the toner image formed in the electrostatic latent image to a recording medium, and a fixing device that fixes the toner image onto a recording medium. The "toner image" means a state where toner particles have been aggregated to form an image.

Figure 5:
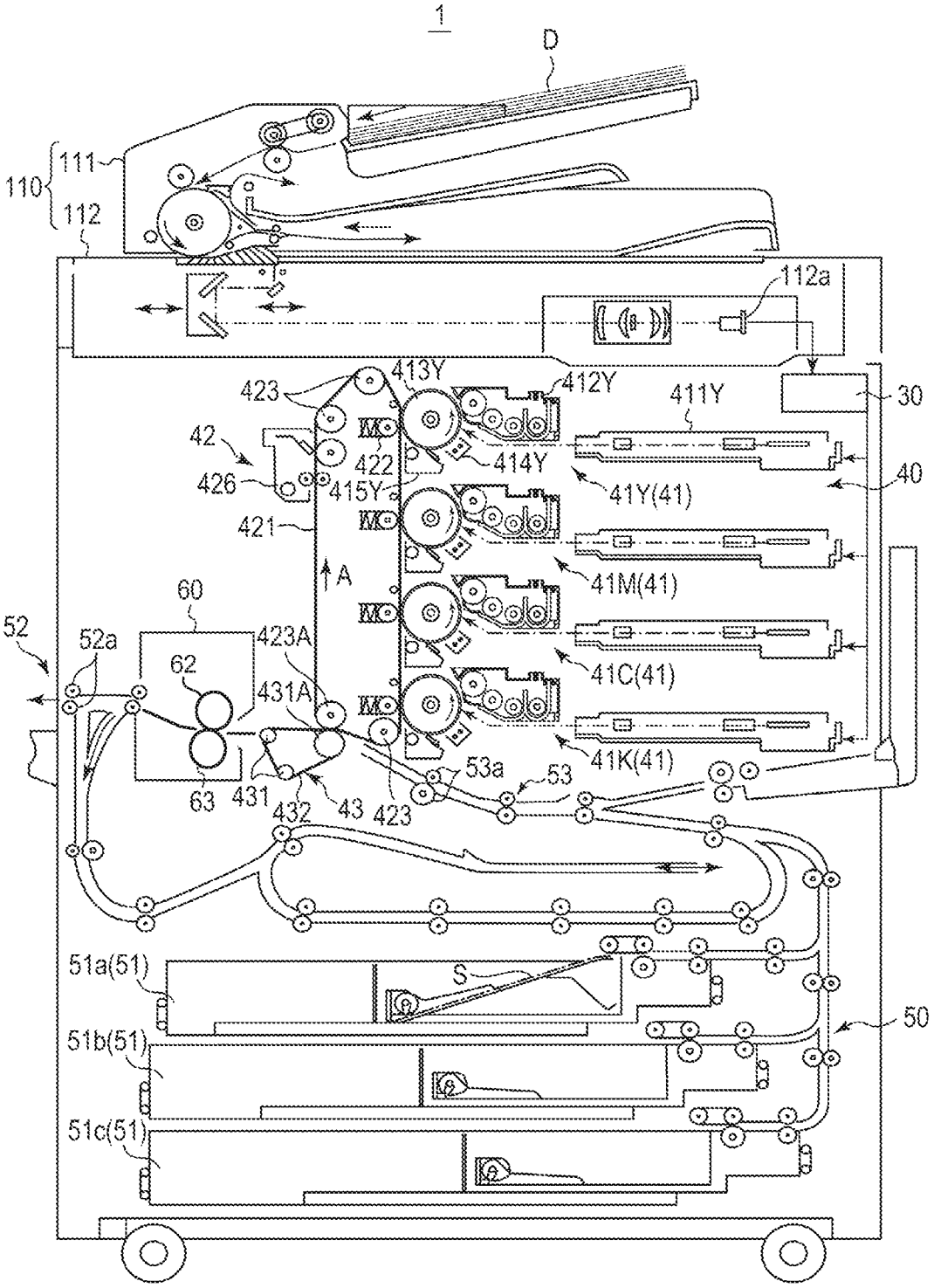
FIG. 5 illustrates schematically a configuration of an image forming apparatus capable of mounting the conductive member according to the present embodiment as an intermediate transfer belt.

FIG. 5 illustrates schematically a configuration of one example of an image forming apparatus having the conductive member according to the embodiment as an intermediate transfer belt. As shown in FIG. 5, image forming apparatus 1 has image reading section 110, image processing section 30, image forming section 40, sheet conveyance section 50 and fixing device 60.

Image forming section 40 has image forming units 41Y, 41M, 41C and 41K that form images by toner of each color of Y (yellow), M (magenta), C (cyan) or K (black). Each of these has the same configuration except for toner to be housed and, therefore, hereinafter, the symbol representing the color may be omitted. Image forming section 40 has additionally intermediate transfer unit 42 and secondary transfer unit 43. These correspond to the transferring device.

Image forming unit 41 has exposing device 411, developing device 412, photoconductor drum 413, charging device 414 and drum cleaning device 415. Photoconductor drum 413 is, for example, a negative charge type organic photoconductor. The surface of photoconductor drum 413 has photoconductivity. Photoconductor drum 413 corresponds to the photoconductor. Charging device 414 is, for example, a corona charger. Charging device 414 may be a contact charging device that contacts a contact charging member such as a charging roller, a charging brush or a charging blade to photoconductor drum 413 to be charged. Exposing device 411 is, for example, formed of a semiconductor laser. Developing device 412 is, for example, a developing device of two-component developing system.

Intermediate transfer unit 42 has intermediate transfer belt 421, primary transfer roller 422 that can press-contact intermediate transfer belt 421 to photoconductor drum 413, a plurality of support rollers 423 including backup roller 423A and belt cleaning device 426. Intermediate transfer belt 421 is an endless belt. Intermediate transfer belt 421 is stretched on a plurality of support rollers 423 in a loop shape. Caused by the rotation of at least one driving roller among a plurality of support rollers 423, intermediate transfer belt 421 runs in arrow A direction at a constant speed. Intermediate transfer belt 421 corresponds to the intermediate transfer member. Primary transfer roller 422 corresponds to a transfer member.

Secondary transfer unit 43 has endless secondary transfer belt 432 and a plurality of support rollers 431 including secondary transfer roller 431A. Secondary transfer belt 432 is stretched by secondary transfer roller 431A and support roller 431 in a loop shape.

Fixing device 60 has fixing roller 62 that heats and fuses the toner forming the toner image on sheet S, and pressure roller 63 that presses sheet S toward fixing roller 62. Sheet S corresponds to a recording medium.

Image forming apparatus 1 has additionally image reading section 110, image processing section 30 and sheet conveyance section 50. Image reading section 110 has automatic document feeder 111 and document image scanning device 112 (scanner). Sheet conveyance section 50 has paper feeding section 51, sheet ejection section 52 and conveyance path section 53. In three paper feed tray units 51*a* to 51*c* configuring paper feeding section 51, sheet S (standard sheet, special sheet) discriminated based on basis weight, size and the like. is housed for every kind previously set. Conveyance path section 53 has a plurality of conveyance roller pairs such as a pair of registration rollers 53*a*.

The formation of an image by image forming apparatus 1 will be explained.

Document image scanning device 112 optically scans and reads document D on contact glass. Reflected light from document D is read by CCD sensor 112*a*, which becomes input image data. The input image data is subjected to prescribed image processing in image processing section 30 and is sent to exposing device 411.

Photoconductor drum 413 rotates at a constant circumferential velocity. Charging device 414 charges uniformly the surface of photoconductor drum 413 to a negative polarity. Exposing device 411 irradiates photoconductor drum 413 with laser light corresponding to input image data of respective color components. In this way, on the surface of photoconductor drum 413, an electrostatic latent image is formed. Developing device 412 allows toner to adhere the surface of photoconductor drum 413 to visualize the electrostatic latent image. In this way, a toner image corresponding to the electrostatic latent image is formed on the surface of photoconductor drum 413.

The toner image on the surface of photoconductor drum 413 is transferred to intermediate transfer belt 421 by intermediate transfer unit 42. A transfer residual toner remaining on the surface of photoconductor drum 413 after the transfer is removed by drum cleaning device 415 having a drum cleaning blade that is slidingly contacted to the surface of photoconductor drum 413.

By the press-contact of intermediate transfer belt 421 to photoconductor drum 413 by primary transfer roller 422, a toner image of each color is transferred, stacked sequentially to intermediate transfer belt 421.

On the other hand, secondary transfer roller 431A is press-contacted to backup roller 423A via intermediate transfer belt 421 and secondary transfer belt 432. Consequently, a transfer nip is formed. Through the transfer nip, sheet S passes. Sheet S is conveyed to the transfer nip by sheet conveyance section 50. The compensation of inclination and adjustment of conveyance timing of sheet S are carried out by a registration roller section provided with a pair of registration rollers 53*a*.

When sheet S is conveyed to the transfer nip, a transfer bias is applied to secondary transfer roller 431A. By the application of the transfer bias, the toner image that is carried on intermediate transfer belt 421 is transferred to sheet S. The transfer residual toner remaining on the surface of intermediate transfer belt 421 is removed by belt cleaning device 426 having a belt cleaning blade slidingly contacted to the surface of intermediate transfer belt 421. Sheet S to which the toner image is transferred is conveyed by secondary transfer belt 432 toward fixing device 60.

Fixing device 60 heats and presses conveyed sheet S in a nip section. Thus, the toner image is fixed to sheet S. Sheet S with the fixed toner image is ejected to the outside of the apparatus by sheet ejection section 52 provided with sheet ejection roller 52*a*.

Since the image forming apparatus has the intermediate transfer belt formed of the conductive member according to the present embodiment, the generation of a transfer failure and an image failure caused by density unevenness in transfer can be suppressed. Consequently, the image forming apparatus can form stably images having a desired image quality.

As is clear from the above explanation, in the conductive particle, since the surface of a conductive carbon black particle is covered with an insulating resin having an amino group, the conductive particle has even and moderate conductivity, and the conductive particle excellent in the dispersibility of a conductive member in a matrix resin is obtained. Accordingly, by dispersing the conductive particles in a matrix resin, the percolation in the conductive member can be prevented. Furthermore, in the conductive member in which the conductive particles are dispersed in a matrix resin, the conductivity of the conductive member can be controlled stably in accordance with the amount of the conductive particles. Consequently, the conductive member is used suitably for an intermediate transfer member of an image forming apparatus that requires an electric property of semiconductivity.

In the present embodiment, since the conductive particle has moderate conductivity, it is possible to manufacture a conductive member of semiconductivity in which the control of conductivity is difficult with high yield. Therefore, according to the present embodiment, an intermediate transfer member having suitable electric characteristics in an image forming apparatus of an electrophotographic system, in particular, an intermediate transfer belt, can be manufactured with high productivity. Further, according to the present embodiment, expansion of demand for a conductive member having electric characteristics of semiconductivity, and additional development of new applications of the conductive member are expected.

Hereinafter, the present invention will be explained more specifically based on Examples and Comparative Examples. However, the present invention is not limited by Examples and Comparative Examples below.

Example 1

(1) Preparation of Dispersion Liquid 100 parts by mass of conductive carbon black particles A1 (trade name "HS100", number-average primary particle diameter (MN): 48 nm, DBP absorption amount (A-DBP): 140 mL/100 g, manufactured by DENKI KAGAKU KOGYO KABUSHIKI KAISHA) was added to 5,000 parts by mass of solvent B (toluene), which was dispersed with an ultrasonic disperser (500 W) for 1 hour.

The number-average primary particle diameter (MN) of conductive carbon black particle A1 was measured by the procedure described below. That is, 100 parts by mass of conductive carbon black particles A1 were put in 5,000 parts by mass of ethanol. To the obtained dispersion liquid, ultrasonic waves (output: 500 W) were applied for 15 minutes to disperse conductive carbon black particles A1 in ethanol. Several droplets of the obtained dispersion liquid were added to a micron grid for TEM, the micron grid was dried and set on FE-TEM (JEM-3100F, manufactured by JEOL Ltd.). Then, the average value of particle diameters of 20 primary particles in the conductive carbon black particle was found, which was defined as the number-average primary particle diameter (MN) of the conductive carbon black particles.

The DBP absorption amount (A-DBP) of conductive carbon black particles A1 was measured in conformity to JIS K6217.

Next, in 5100 parts by mass of the obtained dispersion liquid, insulating resin C1 (amine-modified styrene elastomer, trade name "TAFTEC MP10", manufactured by Asahi Kasei Chemicals Corporation) was added in an amount so that the compounding ratio (Cr1) of insulating resin C1 relative to the total addition amount of insulating resin C1 and conductive carbon black particles A1 became 25% by mass, and the dispersion liquid was stirred at a stirring speed of 600 rpm to dissolve insulating resin C1, and the dispersion liquid was mixed sufficiently. Here, the addition amount (Cr1) of insulating resin C1 is represented by the ratio of the mass of insulating resin C1 relative to the summation of the mass of conductive carbon black particles A1 and the mass of insulating resin C1. "TAFTEC" is a registered trademark of Asahi Kasei Chemicals Corporation.

Next, the dispersed particle diameter (DP1) of conductive carbon black particles A1 in the dispersion liquid was measured with a zeta potential•particle diameter measurement system (ELSZ-1000Z, manufactured by OTSUKA ELECTRONICS CO., LTD.), and the dispersed particle diameter (DP1) of conductive carbon black particles A1 in the dispersion liquid was 125 nm.

(2) Preparation of Emulsion 100 parts by mass of the obtained dispersion liquid was poured into an emulsification tank, and a 5% by mass aqueous solution of an emulsifying agent (a mixed liquid of distilled water and 5% by mass of "EMULGEN 1108") was added at a rate of 100 parts by mass per 10 minutes for 30 minutes (300 parts by mass in total) at ordinary temperature (25° C.) for emulsification. The dispersed particle diameter (DP2) of the dispersoid of the obtained emulsion was measured with a zeta potential•particle diameter measurement system (ELSZ-1000Z, manufactured by OTSUKA ELECTRONICS CO., LTD.), and the dispersed particle diameter (DP2) of the dispersoid of the emulsion was 3.2 μm. "EMULGEN" is a registered trademark of Kao Corporation.

(3) Manufacturing of Surface-Treated Carbon Black

While stirring 100 parts by mass of the obtained emulsion at a stirring speed of 100 rpm, toluene was distilled away from the emulsion at 40° C. under reduced pressure, and the resulting product was cooled, filtrated and, after washing the obtained filtrate with ion-exchanged water, the resulting product was subjected to Nutsche suction filtration to further carry out solid-liquid separation. The separated solid particles were vacuum-dried at 80° C. for 2 hours to give conductive particles 1.

Examples 2 and 3

The process in Example 1 was repeated, except for replacing conductive carbon black particles A1 in Example 1 by conductive carbon black particles A2 (3400B, number-average primary particle diameter: 21 nm, DBP absorption amount: 175 mL/100 g, manufactured by Mitsubishi Chemical Corporation), or by conductive carbon black particles A3 (Asahi 60, number-average primary particle diameter: 45 nm, DBP absorption amount: 114 mL/100 g, manufactured by ASAHI CARBON CO., LTD.) to give conductive particles 2 or conductive particles 3.

Examples 4 and 5

The process in Example 1 was repeated, except for replacing the addition amount of insulating resin C1 in Example 1 by 12% by mass or 48% by mass to give conductive particles 4 or conductive particles 5.

Example 6

The process in Example 1 was repeated, except for replacing insulating resin C1 in Example 1 by insulating resin C2 (polyamide elastomer, TPAE617, manufactured by T&K TOKA Corporation) thereby to give conductive particles 6.

Comparative Examples 1 and 2

The process in Example 1 was repeated, except for replacing conductive carbon black particles A1 in Example 1 by conductive carbon black particles A4 (FX35, number-average primary particle diameter: 26 nm, DBP absorption amount: 220 mL/100 g, manufactured by DENKI KAGAKU KOGYO KABUSHIKI KAISHA), or by conductive carbon black particles A5 (Asahi 55, number-average primary particle diameter: 66 nm, DBP absorption amount: 87 mL/100 g, manufactured by ASAHI CARBON CO., LTD.) to give conductive particles 7 or conductive particles 8.

Comparative Examples 3 and 4

The process in Example 1 was repeated, except for changing the addition amount of insulating resin C1 in Example 1 to 8% by mass or to 53% by mass to give conductive particles 9 or conductive particles 10.

Conductive particles 1 to 6 are set to be "Examples 1 to 6," and conductive particles 7 to 12 are set to be "Comparative Examples 1 to 6."

The amount of insulating resin in obtained conductive particles was found by a method below. First, while using the conductive particles in place of aforementioned conductive carbon black particles, 20 primary particles in the conductive particle were observed, thicknesses of the layers of insulating resin covering the surface of the primary particles were observed, and the average value of the thicknesses was found. Then, while assuming that each of the primary particles had the cover layer of thickness of the average value, the volume ratio of the insulating resin in the conductive particle was calculated, which was converted to a mass ratio to be defined as the amount of the insulating resin in the conductive particle.

Further, 100 parts by mass of the obtained conductive particles was put into 5,000 parts by mass of ethanol, to which ultrasonic waves (output: 500 W) were applied for 15 minutes to disperse the conductive particles in the ethanol, and the dispersed particle diameter (DP3) of the conductive particle in the obtained dispersion liquid was measured with a zeta potential•particle diameter measurement system (ELSZ-1000Z, manufactured by OTSUKA ELECTRONICS CO., LTD.).

Compositions and physical properties of conductive particles 1 to 12 are shown in Table 1. "Cr2" in Table 1 is the compounding ratio (% by mass) of the insulating resin relative to the total addition amount of the insulating resin and the conductive carbon black particles.

TABLE 1

| | Conductive | Conductive carbon black particle | | | | Insulating resin | | | Conductive particle | |
|---|---|---|---|---|---|---|---|---|---|---|
| | particle No. | Kind | MN (nm) | A-DBP (mL/100 g) | DP1 (nm) | Kind | Cr1 (% by mass) | DP2 (μm) | DP3 (μm) | Cr2 (% by mass) |
| Example 1 | 1 | A1 | 48 | 140 | 125 | C1 | 25 | 3.2 | 2.4 | 23.9 |
| Example 2 | 2 | A2 | 21 | 175 | 201 | C1 | 25 | 4.8 | 3.3 | 24.2 |
| Example 3 | 3 | A3 | 45 | 114 | 130 | C1 | 25 | 3.9 | 2.8 | 24.1 |
| Example 4 | 4 | A1 | 48 | 140 | 125 | C1 | 12 | 3.4 | 2.6 | 11.5 |
| Example 5 | 5 | A1 | 48 | 140 | 125 | C1 | 48 | 3.6 | 2.5 | 47.4 |
| Example 6 | 6 | A1 | 48 | 140 | 125 | C2 | 25 | 4.1 | 3.2 | 25.1 |
| Comparative Example 1 | 7 | A4 | 26 | 220 | 890 | C1 | 25 | 7.7 | 6.5 | 24.7 |
| Comparative Example 2 | 8 | A5 | 66 | 87 | 116 | C1 | 25 | 4.1 | 3.1 | 24.6 |
| Comparative Example 3 | 9 | A1 | 48 | 140 | 125 | C1 | 8 | 2.7 | 2.1 | 8.2 |
| Comparative Example 4 | 10 | A1 | 48 | 140 | 125 | C1 | 53 | 4.9 | 3.8 | 52.1 |
| Comparative Example 5 | 11 | A1 | 48 | 140 | 125 | C3 | 25 | 6.7 | 5.2 | 24.8 |
| Comparative Example 6 | 12 | A1 | 48 | 140 | 125 | — | — | — | 0.125 | — |

Comparative Example 5

The process in Example 1 was repeated, except for replacing insulating resin C1 in Example 1 by insulating resin C3 (polyethylene, trade name "UMERIT 125FN", manufactured by UBE-MARUZEN POLYETHYLENE CO., LTD) to give conductive particles 11.

Comparative Example 6

Conductive carbon black particles A1 themselves were prepared as conductive particles 12.

Example 7

Conductive multilayer belt 1 having a base material layer, an elastic layer containing conductive particles, and a surface layer was produced by a procedure shown below.

(1) Production of Base Material Layer

Under nitrogen flow, 47.6 g of 4,4'-diaminodiphenyl ether (ODA) was added to 488 g of N-methyl-2-pyrrolidone, which was kept at 50° C. and stirred to be dissolved completely. To the solution, 70 g of 3,3',4,4'-biphenyltetracarboxylic dianhydride (BPDA) was added gradually to give 605.6 g of a polyamic acid solution. The polyamic acid had number average molecular weight of 17,000, the solution had viscosity of 35 poise (3.5 Pa·s), and solid content concentration of 18.0% by mass.

Next, to 450 g of the polyamic acid solution, 21 g of acidic carbon (pH 3.0) and 80 g of N-methyl-2-pyrrolidone were added, and the acidic carbon (CB) was dispersed homogeneously with a ball mill to give a first master batch solution. The solid content concentration in the first master batch solution was 18.5% by mass, and the CB concentration in the solid content was 20.6% by mass.

On the other hand, a cylindrical metallic mold was prepared. The cylindrical metallic mold is a vessel having a room in a cylinder shape capable of housing the first master batch solution in the inside, the room having an inside diameter of 301.5 mm and the length of 540 mm. The surface of the inner circumference of the cylindrical metallic mold is mirror-finished. The cylindrical metallic mold is mounted on two rotation rollers, and rotates with the rotation of the rotation rollers. Further, around the cylindrical metallic mold mounted on the rotation rollers, a far infrared heater was disposed toward the outside surface of the cylindrical metallic mold in non-contact with the outside surface. The far infrared heater is designed so as to control the temperature of internal surface of the cylindrical metallic mold on the rotation rollers at 120° C.

First, 276 g of the first master batch solution was housed in the cylindrical metallic mold, which was mounted on the rotation rollers, and the cylindrical metallic mold was rotated by the rotation rollers to coat uniformly the first master batch solution on the surface of inner circumference of the cylindrical metallic mold. Next, heating was started. The heating was carried out so that the temperature at the surface of the inner circumference of the cylindrical metallic mold increased at a rate of 1° C./min and the temperature was maintained at 120° C. for 60 minutes. During the heating, the cylindrical metallic mold was rotated continuously by the rotation rollers.

After the end of the rotation and heating, the cylindrical metallic mold was moved from on the rotation roller into a hot-air convection oven as it was without cooling, and was left at rest in the oven to start heating for imidization. The heating was carried out so as to increase the inner temperature of the oven gradually and, when the inner temperature of the oven reached 320° C., to keep the temperature for 30 minutes. After the heating, the cylindrical metallic mold was cooled to ordinary temperature, and a polyimide belt formed on the inner surface of the cylindrical metallic mold in a tube shape was peeled off and taken out to give a base material layer belt in a tube shape. The obtained base material layer belt had a thickness of 82 μm, length of outer circumference of 944.3 mm, surface resistivity of 12.72 (Log Ω/□), and volume resistivity of 10.61 (Log Ω·cm).

(2) Production of Elastic Layer

Seven parts by mass of conductive particles 1 were added to 500 parts by mass of tetrahydrofuran, which was dispersed by ultrasonic waves (500 W) for 1 hour. To the obtained dispersion liquid, 100 parts by mass of thermoplastic polyurethane (E574, manufactured by Nippon Miractran Co, Ltd.) was added, which was stirred with a blade stirrer (600 rpm) and dissolved in tetrahydrofuran to prepare a second master batch solution.

The second master batch solution was housed in the cylindrical metallic mold in an amount that was to give an elastic layer having a thickness of 200 μm, and the cylindrical metallic mold was rotated on the rotation rollers to coat uniformly the solution on the inner surface of the metal mold, and heat drying was carried out. The heating was carried out so that the temperature at the surface of the inner circumference of the cylindrical metallic mold increased at a rate of 2° C./min and was kept at 80° C. for 60 minutes. During the heating, the cylindrical metallic mold was rotated continuously by the rotation rollers. Thus, elastic layer belt 1 in a tube shape was produced.

(3) Bonding of Base Material Layer Belt and Elastic Layer Belt

On the surface of inner circumference of elastic layer belt 1, primer DY39-067 (manufactured by Toray•Dow Corning Corporation) was coated and air-dried. Next, on the surface of the outer circumference of the base material layer belt, dry lamination adhesive (TakeracA-969, manufactured by MITSUI CHEMICALS POLYURETHANES, INC.) was coated thinly. Then, the base material layer belt was inserted into elastic layer belt 1 and was superposed. Next, while pressure-bonding the base material layer belt from the surface of the inner circumference side of the base material layer belt, the base material layer belt and the elastic layer belt were heated under a circumstance at 80° C. to bond both belts. Both end parts of the bonded belts were cut to give multilayer belt 1 of 360 mm in width.

(4) Production of Surface Layer

One hundred parts by mass of metal oxide particles (aluminum oxide, particle diameter: 34 nm) and 15 parts by mass of a compound having a radical-polymerizable functional group as a surface treating agent were added to 400 parts by mass of a solvent (mixed solvent of toluene: isopropyl alcohol=1:1), which was dispersed using a wet media dispersion type apparatus. Next, the solvent was removed to manufacture a reactive metal oxide particle with a surface treated with the compound having a radical-polymerizable functional group. The amount of surface treatment of the obtained reactive metal oxide particle with the compound having a radical-polymerizable functional group (the amount covered with the compound having a radical-polymerizable functional group) was 12% by mass relative to the fine particles of the metal oxide. The amount of surface treatment with the compound having a radical-polymerizable functional group is a value found by heat-treating the metal oxide particles after the surface treatment at 55° C. for 3 hours, analyzing quantitatively the residue on ignition of the metal oxide particles by fluorescence X-ray, and subjecting the same to molecular weight conversion from the amount of Si.

One hundred parts by volume of the reactive metal oxide particles, 100 parts by volume of an active energy ray-curable monomer and 50 parts by volume of a fluorine-containing resin/siloxane graft type resin ZX-212 (nonvolatile content: 47%, manufactured by FUJI KASEI CO., LTD.) were mixed in 5,000 parts by volume of a solvent (methyl isobutyl ketone), which was subjected to a dispersion treatment with a horizontal circulation dispersing apparatus (DISPERMAT: manufactured by EKO Instruments) charged with a zirconia bead of φ 0.5 mm so as to give a packing ratio of 80% at 1,000 rpm. To the obtained dispersion liquid, 13 parts by volume of a photopolymerization initiator (Irgacure 379, manufactured by Ciba-Geigy) was mixed to prepare a coating liquid for forming a surface layer.

The obtained coating liquid for forming a surface layer was coated on the surface of the elastic layer belt side of multilayer belt 1 by a dip coating method so as to give a dry thickness of 2 μm under coating conditions described below to form a coated film. Next, multilayer belt 1 was held with a freely rotatable cylindrical base body, and ultraviolet rays as an active energy ray were applied to the coated film, with rotation at 60 mm/s, under irradiation conditions described below to cure the coated film and to form a surface layer on the elastic layer. In this way, conductive multilayer belt 1 having an elastic layer, in which conductive particles 1 were dispersed, was produced. Conductive multilayer belt 1 had a thickness of 280 μm and an outer circumference length of 945.0 mm.

(Coating Condition)

Supply amount of coating liquid: 1 L/min

Pull-up rate: 4.5 mm/min

Meanwhile, the supply amount of coating liquid is a circulation amount when the coating liquid is supplied continuously to a dip tank into which the multilayer belt is to be sunk and an overflowing coating liquid is circulated to the dip tank.

(Irradiation Condition)

Type of light source: high pressure mercury lamp (H04-L41: manufactured by EYE GRAPHICS CO., LTD.)

Distance from irradiation opening to surface of coated liquid for forming surface layer: 100 mm Irradiation dose: 1 J/cm$^2$ Irradiation time (time during which base body is rotated): 240 seconds

Examples 8 to 12 and Comparative Examples 7 to 12

The process for forming conductive multilayer belt 1 was repeated to form conductive multilayer belts 2 to 6, except for using each of conductive particles 2 to 6 in place of conductive particles 1 so that the amount of the conductive particles relative to the total amount of the thermoplastic polyurethane and the conductive particles gave 7% by mass, 7% by mass, 5% by mass, 9% by mass and 7% by mass, respectively. In addition, the process for forming conductive multilayer belt 1 was repeated to form conductive multilayer belts 7 to 12, except for using each of conductive particles 7 to 12 in place of conductive particles 1 so that the amount of the conductive particles relative to the total amount of the thermoplastic polyurethane and the conductive particles gave 7% by mass, 20% by mass, 3% by mass, 20% by mass, 20% by mass and 3% by mass, respectively. Conductive multilayer belts 1 to 6 are set to be "Examples 7 to 12," and conductive multilayer belts 7 to 12 are set to be "Comparative Examples 7 to 12."

[Evaluation]

(1) Productivity

One hundred conductive multilayer belts 1 to 12, respectively, were produced, and the surface resistivity of each of produced conductive multilayer belts 1 to 12 was measured in conformity with JIS K6911. Then, among the produced conductive multilayer belts, conductive multilayer belts having a measured value in the range of $1.0\times10^{9}$ to $1.0\times10^{13}\Omega/\square$ were evaluated as good products, and respective yields of conductive multilayer belts 1 to 12 were found. Results are shown in Table 2.

(2) Uniformity of Electric Resistance

The surface resistivity of 10 points lying evenly in the circumferential direction of the belt on the surface of the conductive multilayer belt of the good product was measured, and the difference between common logarithms of the maximum measured value and the minimum measured value was found as variation of the surface resistivity. Then, for each of conductive multilayer belts 1 to 12, the average value of the variations was calculated, which was defined as the variation in the surface resistivity in each of conductive multilayer belts 1 to 12. Results are shown in Table 2.

(3) Image Quality Evaluation

Each of conductive multilayer belts 1 to 12 was mounted to the image forming apparatus as shown in FIG. 5 as an intermediate transfer belt, and a formed image was evaluated. In more detail, as printed samples of each of colors of Y, M, C and K, 5 to 10 of entire surface halftone images of 25% of coverage rate and entire surface solid images of 100% of coverage rate, respectively, were formed continuously, and obtained printed samples of respective colors were evaluated based on the criteria described below. Results are shown in Table 2.

(Evaluation Criteria)

A: neither transfer failure nor unevenness exists, good

B: certain transfer unevenness exists, but, practical level

C: transfer failure and unevenness are generated remarkably, impractical level

TABLE 2

| | Conductive multilayer belt No. | Yield (%) | Variation in surface resistivity | Image evaluation | Remarks |
|---|---|---|---|---|---|
| Example 7 | 1 | 98 | 0.1 | A | Example |
| Example 8 | 2 | 69 | 0.5 | B | |
| Example 9 | 3 | 83 | 0.3 | A | |
| Example 10 | 4 | 72 | 0.6 | B | |
| Example 11 | 5 | 80 | 0.1 | A | |
| Example 12 | 6 | 95 | 0.1 | A | |
| Comparative Example 7 | 7 | 10 | 2.3 | C | Comparative Example |
| Comparative Example 8 | 8 | 0 | — | — | |
| Comparative Example 9 | 9 | 4 | 2.1 | C | |
| Comparative Example 10 | 10 | 0 | — | — | |
| Comparative Example 11 | 11 | 0 | — | — | |
| Comparative Example 12 | 12 | 2 | 1.8 | C | |

(4) Change in Electric Resistance

The process of manufacturing conductive multilayer belt 1 was repeated to produce conductive multilayer belts 1-1 to 1-5, except for setting the addition amount (Cm) of conductive particles 1 relative to the total amount of the thermoplastic polyurethane and the conductive particles to be 2.0, 4.0, 6.0, 8.0 and 10.0% by mass, respectively.

Similarly, the process of manufacturing conductive multilayer belt 1 was repeated to produce conductive multilayer belts 9-1 to 9-5, except for setting the addition amount (Cm) of conductive particles 9 relative to the total amount of the thermoplastic polyurethane and the conductive particles to be 2.0, 4.0, 6.0, 8.0 and 10.0% by mass, respectively.

Further, the process of manufacturing conductive multilayer belt 1 was repeated to produce conductive multilayer belts 10-1 to 10-5, except for setting the addition amount (Cm) of conductive particles 10 relative to the total amount of the thermoplastic polyurethane and the conductive particles to be 2.0, 4.0, 6.0, 8.0 and 10.0% by mass, respectively.

Furthermore, the process of manufacturing conductive multilayer belt 1 was repeated to produce conductive multilayer belts 12-1 to 12-5, except for setting the addition amount (Cm) of conductive particles 12 relative to the total amount of the thermoplastic polyurethane and the conductive particles to be 2.0, 4.0, 6.0, 8.0 and 10.0% by mass, respectively.

In addition, the process of manufacturing conductive multilayer belt 1 was repeated to produce multilayer belt 0, except for not adding conductive particles 1.

The surface resistivity (ρs) of each of conductive multilayer belts 1-1 to 1-5 in Examples, and multilayer belt 0, conductive multilayer belts 9-1 to 9-5, 10-1 to 10-5 and 12-1 to 12-5 in Comparative Examples was measured by the aforementioned method. The surface resistivity (ρs) of each of conductive multilayer belts 1-1, 9-1, 10-1, 12-1 and multilayer belt 0 was about $1.0\times10^{16}\Omega/\square$. Results are shown in FIG. 6.

Figure 6:
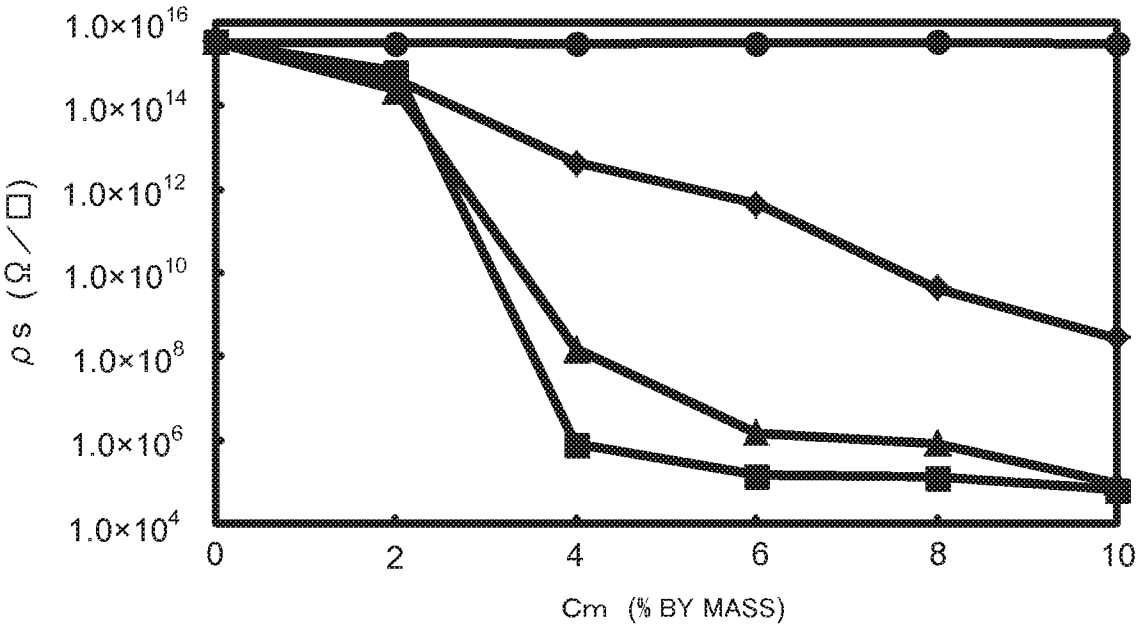
FIG. 6 illustrates a relationship between surface resistivity (ρs) and the content (Cm) of conductive particles in a conductive multilayer belt in Examples and Comparative Examples.

In FIG. 6, conductive multilayer belts 1-1 to 1-5 are plotted with "♦," conductive multilayer belts 9-1 to 9-5 are plotted with "▲," conductive multilayer belts 10-1 to 10-5 are plotted with "●," and conductive multilayer belts 12-1 to 12-5 are plotted with "■."

As shown in Table 2, the variation in the surface resistivity of conductive multilayer belts 1 to 6 is small such as an order of 0.1 to 0.6, and the image evaluation lies in the range of causing no problem in practical uses for each of conductive multilayer belts 1 to 6. Further, as shown in FIG. 6, even when the surface resistivity lies in the range of $1\times10^{9}$ to $1\times10^{13}\Omega/\square$ that is referred to as semiconductivity, too, in the case where the amount of conductive particles 1 in conductive multilayer belt 1 is increased, the ratio of decrease in the surface resistivity of conductive multilayer belt 1 decreases in a straight line shape downward to the right when the surface resistivity on the ordinate axis is represented by a logarithmic scale and the content on the abscissa axis is represented by an ordinary integer scale. That is, in the range of semiconductivity, too, the ratio of change in the surface resistivity relative to the amount of conductive particles 1 in conductive multilayer belt 1 is small.

On the other hand, as shown in Table 2, conductive multilayer belt 7 shows larger variation in the surface resistivity as compared with conductive multilayer belts 1 to 6, and evident density unevenness was observed in an output image. This is considered to be attributed to too large a DBP absorption value of the conductive particle to deteriorate dispersibility of the conductive carbon black particles in the elastic layer.

Further, in conductive multilayer belt 8, the surface resistivity was too high, and, even when the amount of conductive particles 8 was adjusted, the surface resistivity of conductive multilayer belt 8 did not fall within the range of $1.0\times10^{9}$ to $1.0\times10^{13}\Omega/\square$. Therefore, as shown in Table 2, a measurement value of variation in the surface resistivity was not able to be obtained, and, since it was not able to be used as an intermediate transfer belt, an image was not able to be evaluated. This is considered to be attributed to too large a number-average primary particle diameter of the conductive carbon black particle and too small a DBP absorption amount, which reduced the conduction efficiency in the conductive multilayer belt.

In conductive multilayer belt 9, as shown in FIG. 6, in the range of the semiconductivity, the ratio of change in the surface resistivity relative to the amount of the conductive particles in the conductive multilayer belt was remarkably large. That is, in the range of the semiconductivity, the percolation was generated. As the result, as shown in Table 2, conductive multilayer belt 9 showed a larger variation in the surface resistivity as compared with conductive multilayer belts 1 to 6, and, when it was used as an intermediate transfer belt, evident density unevenness was observed in an output image. This is considered to be attributed to too small a amount of the insulating resin in the conductive particle thereby not to cause the suppression effect of percolation to be expressed sufficiently.

In conductive multilayer belt 10, as shown in FIG. 6, the surface resistivity was too high and changed scarcely when the amount of the conductive particles was increased. Therefore, as shown in Table 2, the measurement value of a variation in the surface resistivity was not able to be obtained and, since the belt was not able to be used as an intermediate transfer belt, an image was not able to be evaluated. This is considered to be attributed to too large a number-average primary particle diameter of the conductive carbon black particle and too small a DBP absorption amount, which reduced the conduction efficiency in the conductive multilayer belt.

In conductive multilayer belt 11, as shown in Table 2, the surface resistivity of the conductive multilayer belt was too high. As the result, a measurement value of a variation in the surface resistivity c was not able to be obtained and, since the belt was not able to be used as an intermediate transfer belt, an image was not able to be evaluated. This is considered to be attributed to too high a contact resistance between the insulating resin and the conductive carbon black particle because no amino group is contained in the insulating resin, which reduced the conductivity of the conductive particle.

In conductive multilayer belt 12, as shown in FIG. 6, the ratio of change in the surface resistivity relative to the amount of the conductive particles in the conductive multilayer belt was remarkably large, in the range of the semiconductivity. That is, in the range of the semiconductivity, the percolation was generated. As the result, in conductive multilayer belt 12, as shown in Table 2, the variation in the surface resistivity was large as compared with conductive multilayer belts 1 to 6, and, when the belt was used as an intermediate transfer belt, evident density unevenness was observed in an output image. This is considered to be attributed to the more remarkable generation of the percolation caused by the contact between conductive carbon black particles each other because the conductive carbon black particle does not have an insulating resin that might adhere closely.

From above, it is understood that the conductive particle, in which the number-average primary particle diameter of a conductive carbon black particle is from 20 to 60 nm, the cover layer is formed of an insulating resin having an amino group, the amount of the insulating resin in the conductive particle is from 10 to 50% by mass and a DBP absorption amount of the conductive carbon black particle is from 100 to 200 mL/100 g, when compounded in a conductive member, suppresses the percolation of the conductive member, in particular, of the conductive member of semiconductivity. Accordingly, it is understood that the conductive member can be manufactured with a high yield. Furthermore, it is understood that the use of the conductive member for an intermediate transfer belt of an image forming apparatus can form a good image in which transfer failure and transfer unevenness are suppressed.

What is claimed is:

1. A conductive member comprising a matrix resin and conductive particles dispersed in the matrix resin, wherein:

a surface resistivity is from $1.0\times10^{9}$ to $1.0\times10^{13}\Omega/\square$;

the conductive particles each have a conductive carbon black particle and a cover layer that is in contact with and covers a surface of the conductive carbon black particle;

a number-average primary particle diameter of the conductive carbon black particle is from 20 to 60 nm;

a dibutylphthalate absorption amount of the conductive carbon black particle is from 100 to 200 mL/100 g;

the cover layer is formed of an insulating resin having an amino group;

the insulating resin is an amine-modified styrene elastomer, a polyamide elastomer, a polyamide, or a polyamideimide; and an amount of the insulating resin in the conductive particle is from 10 to 50% by mass.

2. The conductive member according to claim 1, wherein the number-average primary particle diameter of the conductive carbon black particle is from 30 to 50 nm.

3. The conductive member according to claim 1, wherein the dibutylphthalate absorption amount of the conductive carbon black particle is from 100 to 150 mL/100 g.

4. The conductive member according to claim 1, wherein a surface resistivity of the insulating resin is $1\times10^{13}\Omega/\square$ or more.

5. The conductive member according to claim 1, wherein the insulating resin is the amine-modified styrene elastomer or the polyamide elastomer.

6. The conductive member according to claim 1, wherein an amount of the conductive particles is from 1 to 50 parts by mass relative to 100 parts by mass of the matrix resin.

7. An image forming apparatus comprising an intermediate transfer belt for transferring a toner image formed on an electrophotographic photoconductor to a recording medium, wherein the intermediate transfer belt is formed of the conductive member according to claim 1.

8. A conductive particle comprising a conductive carbon black particle and a cover layer that is in contact with and covers a surface of the conductive carbon black particle, wherein:

a number-average primary particle diameter of the conductive carbon black particle is from 20 to 60 nm;

a dibutylphthalate absorption amount of the conductive carbon black particle is from 100 to 200 mL/100 g;

the cover layer is formed of an insulating resin having an amino group;

the insulating resin is an amine-modified styrene elastomer, a polyamide elastomer, a polyamide, or a polyamideimide; and an amount of the insulating resin in the conductive particle is from 10 to 50% by mass.

9. The conductive particle according to claim 8, wherein the number-average primary particle diameter of the conductive carbon black particle is from 30 to 50 nm.

10. The conductive particle according to claim 8, wherein the dibutylphthalate absorption amount of the conductive carbon black particle is from 100 to 150 mL/100 g.

11. The conductive particle according to claim 8, wherein a surface resistivity of the insulating resin is $1\times10^{13}\Omega/\square$ or more.

12. The conductive particle according to claim 8, wherein the insulating resin is the amine-modified styrene elastomer or the polyamide elastomer.

13. A method for manufacturing a conductive particle having a conductive carbon black particle a surface of which is in contact with and covered with a cover layer formed of an insulating resin, comprising:

adding an aqueous medium to a hydrophobic dispersion liquid that is prepared by dissolving an insulating resin in a hydrophobic organic solvent and dispersing conductive carbon black particles, in an amount larger than that of the hydrophobic dispersion liquid to emulsify the aqueous medium and the hydrophobic dispersion liquid; and distilling away the organic solvent from an emulsion of the hydrophobic dispersion liquid and the aqueous medium to fix the insulating resin to a surface of the conductive carbon black particle, wherein;

a number-average primary particle diameter of the conductive carbon black particle is from 20 to 60 nm;

a dibutylphthalate absorption amount of the conductive carbon black particle is from 100 to 200 mL/100 g; and the insulating resin is an amine-modified styrene elastomer, a polyamide elastomer, a polyamide, or a polyamideimide.

14. The conductive member according to claim 1, wherein the cover layer uniformly adheres to the surface of the conductive carbon black particle.

15. The conductive member according to claim 1, wherein the cover layer is formed by a phase-inversion emulsification method that employs as an oil phase a hydrophobic dispersion liquid containing the conductive carbon black particle dispersed and the insulating resin dissolved.

16. The conductive particle according to claim 8, wherein the cover layer is formed by a phase-inversion emulsification method that employs as an oil phase a hydrophobic dispersion liquid containing the conductive carbon black particle dispersed and the insulating resin dissolved.

17. The conductive member according to claim 1, wherein a thickness of the cover layer is from 1 to 10 nm.

* * * * *